United States Patent [19]

Marshall

[11] 4,029,211

[45] June 14, 1977

[54] FOLDING CLOTHES RACK WITH STABILIZING HINGES AND SHOE SUPPORTS

[76] Inventor: Mary L. Marshall, 142 E. Wilkinson, Shreveport, La. 71104

[22] Filed: Feb. 12, 1974

[21] Appl. No.: 441,844

[52] U.S. Cl. ..... 211/104; 211/199; 211/204

[51] Int. Cl.[2] ..... A47F 5/10

[58] Field of Search ..... 211/38, 85, 104, 105, 211/118, 132, 149, 168, 178 R, 179; 248/226 E, 351, 434; 403/62, 73

[56] References Cited

UNITED STATES PATENTS

| | | | |
|---|---|---|---|
| 127,948 | 6/1872 | Bassett | 211/178 R |
| 166,053 | 7/1875 | Winter | 211/178 R |
| 576,815 | 2/1897 | Grant | 211/178 R |
| 577,399 | 2/1897 | Marks | 211/178 R |
| 1,150,109 | 8/1915 | Flanders | 211/178 R X |
| 1,260,163 | 3/1918 | Downie | 211/104 X |
| 2,440,513 | 4/1948 | Kaelin et al. | 211/178 R |
| 2,816,668 | 12/1957 | Marshall | 211/104 |
| 2,919,818 | 1/1960 | Clegg et al. | 211/178 |
| 3,276,545 | 10/1966 | D'Angelo | 211/178 R X |
| 3,507,402 | 4/1970 | Barbee | 211/178 R |

FOREIGN PATENTS OR APPLICATIONS

| | | | |
|---|---|---|---|
| 1,200,011 | 6/1959 | France | 211/149 |
| 1,325,630 | 4/1963 | France | 211/104 |
| 387,467 | 4/1923 | Germany | 248/434 |

*Primary Examiner*—Ramon S. Britts
*Assistant Examiner*—Thomas J. Holko
*Attorney, Agent, or Firm*—Clarence A. O'Brien; Harvey B. Jacobson

[57] ABSTRACT

A plurality of upright standards are provided spaced along a horizontal zigzag path and a plurality of pairs of upper and lower horizontal spacing and support members extend between and have their opposite ends pivotally supported from the upper and lower ends, respectively, of pairs of adjacent standards disposed along said path for horizontal swinging of the supports and standards relative to adjacent supports and standards. An articulated connecting link is connected between one standard and the second standard spaced therefrom and the link includes a pair of link sections having one pair of ends pivotally secured together for relative angular displacement about a horizontal axis extending transversely of the sections. The other pair of ends of the links include anchor portions pivotally secured thereto for oscillation about axes generally paralleling the axis of relative angular displacement of the link sections and supported from the corresponding standards for angular displacement relative thereto about axes extending longitudinally therealong. Also, at least some of the lower horizontal spacing and support members include upwardly projecting support rods upon which articles of apparel may be supported.

1 Claim, 3 Drawing Figures

FOLDING CLOTHES RACK WITH STABILIZING HINGES AND SHOE SUPPORTS

BACKGROUND OF THE INVENTION

The instant invention comprises an improvement over the folding clothes rack disclosed in my prior U.S. Pat. No. 2,816,668, dated Dec. 17, 1957.

My previously patented clothes rack is similar in construction, except that it did not include lower horizontal spacing and support members, connecting links for limiting relative swinging movement of certain of the standard portions of the rack away from each other and each of the standards of my prior clothes rack is independently supported from the other standards solely by the upper spacing and support members. As a result, the standards of my prior rack are not securely supported relative to each other and they may be swung to excessively extended positions relative to each other in a manner greatly reducing the stability of the clothes rack.

BRIEF DESCRIPTION OF THE INVENTION

The folding clothes rack of the instant invention includes a plurality of generally rectangular upstanding frames each including a pair of rigidly relatively braced standards and each pair of standards is connected to the adjacent pair of standards by means of a pair of upper and lower horizontal spacing and support members extending between and having their opposite ends pivotally supported from the upper and lower ends, respectively, of the adjacent standards of adjacent frames. In this manner, considerably more stability is provided. In addition, the provision of lower horizontal spacing and support members as well as upper horizontal spacing and support members further complements the stability of the clothes rack and the provision of articulated connecting links between each pair of adjacent frames limits the extend to which the rack may be extended and thereby ensures that it will not be excessively extended so as to adversely affect its stability.

The main object of this invention is to provide an improved folding clothes rack having considerable stability.

Another object of this invention is to provide an improved folding clothes rack including structure by which extension of the folding clothes rack will be limited.

Yet another object of this invention is to provide a folding clothes rack including improved lower wearing apparel support structures.

A final object of this invention to be specifically enumerated herein is to provide a folding clothes rack in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafater described and claimed, reference being had to the accompanying drawings forming a part hereof, wherein like numerals refer to like parts throughout.

DETAILED DESCRIPTION OF THE INVENTION

Figure 1:
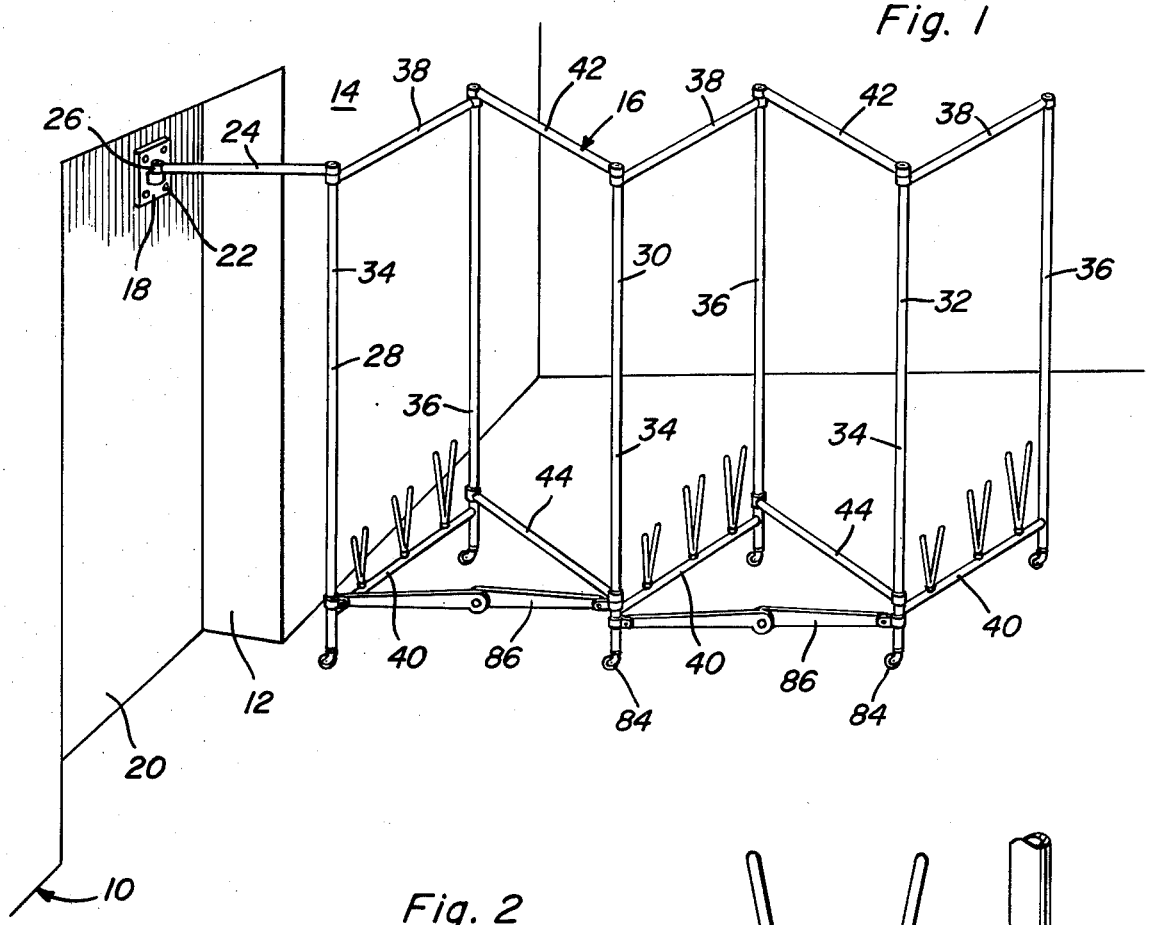
FIG. 1 is a perspective view of the clothes rack in a fully extended position spaced outwardly from a wall recess into which the clothes rack may be collapsed.
Figure 2:
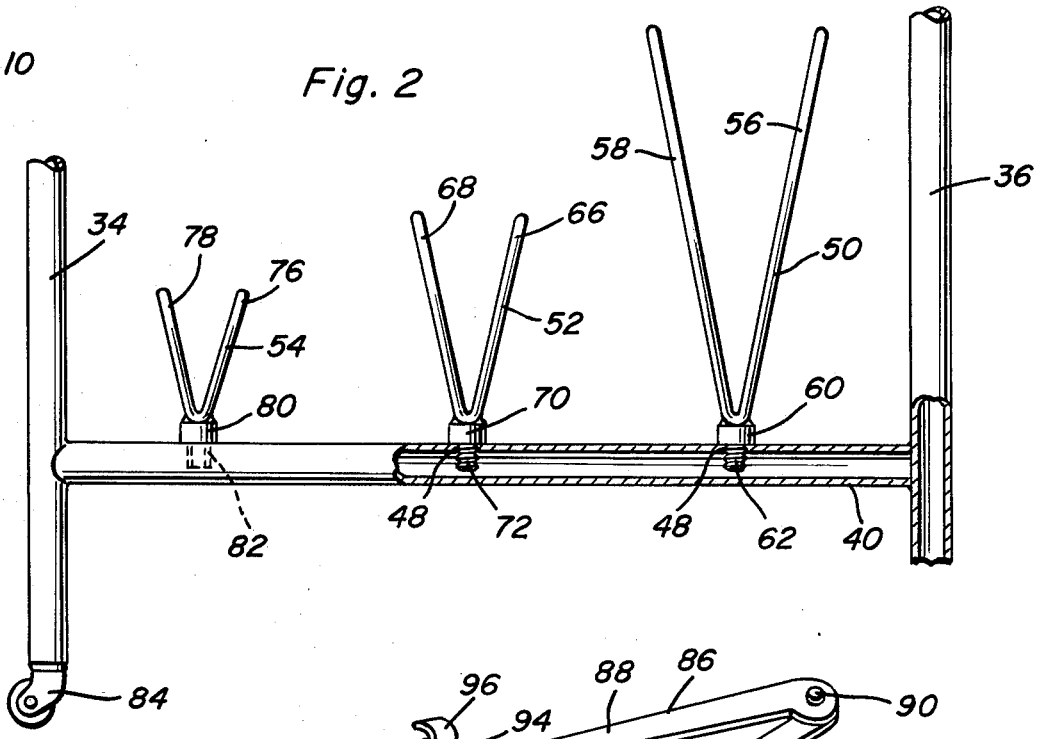
FIG. 2 is an enlarged fragmentary elevational view of a lower portion of one of the frames of which the clothes rack is constructed and with portions of the frame being broken away and illustrated in vertical section.

A building structure is generally referred to by the reference numeral 10 in FIG. 1 and includes an upstanding recess 12 in one wall 14 thereof. The rack of the instant invention is referred to in general by the reference numeral 16 and includes a mounting plate 18 secured to an upper portion of the inner wall 20 of the recess 12 in any convenient manner such as by fasteners 22. One end of a horizontal support arm 24 is pivotally supported as at 26 to the mounting bracket 18 and the rack 16 further includes three upstanding frames 28, 30 and 32. Each frame 28, 30 and 32 includes a pair of upright standards 34 and 36 interconnected at their upper and lower ends by means of upper and lower horizontal braces 38 and 40 extending between and rigidly secured to the corresponding standards 34 and 36.

The standards 36 of the frames 28 and 30 are connected to the standards 34 of the frames 30 and 32 by means of upper and lower horizontal spacing and support members 42 and 44 extending therebetween. The opposite ends of the spacing and support members 42 and 44 are rotatably supported from the corresponding standards 36 and 34 for angular displacement about the longitudinal axes of the standards 36 and 34 and each of the brace members 40 comprises a tubular member having the plurality of threaded openings 48 formed therein along its upper surface. Each brace member 40 is provided with three upright V-shaped wearing apparel supports 50, 52, and 54. The support 50 includes a pair of upwardly divergent rods 56 and 58 joined together at their lower ends by means of a mount 60 provided with a depending threaded shank 62 threadedly engages in one of the bores 48. Each of the supports 52 includes a pair of upwardly divergent rods 66 and 68 joined together at their lower ends by means of a mount or base 70 includng a threaded depending shank 72 threadedly engaged in a second of the bores 48 and the support 54 includes a pair of upwardly divergent rods 76 and 78 joined together at their lower ends by means of a base 80 including a depending threaded shank 82 threadedly engaged in the third threaded bore 48. Each of the rods 56, 58, 66, 68, 76, 78 may be used to support an article of wearing apparel such as a shoe or boot or other article of clothing.

The lower ends of each of the standards 34 and 36 is provided with a caster wheel assembly 84 and an articulated connecting link 86 is secured between the standard 34 of the frame 28 and the standard 34 of the frame 30. Also, a second articulated connecting link 86 is connected between the standard 34 of the frame 30 and the standard 34 of the frame 32.

Figure 3:
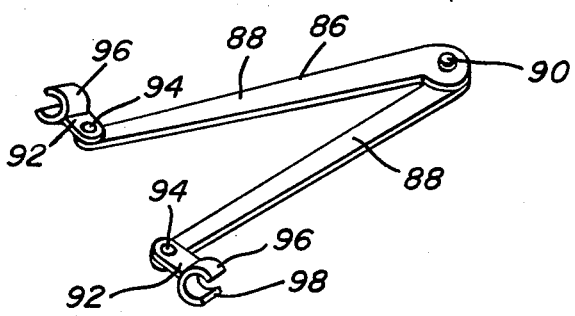
FIG. 3 is a perspective view of one of the articulated connecting links of the clothes rack illustrated in a folded position.

With attention now invited more specifically to FIGS. 1 and 3 of the drawings it may be seen that each of the articulated connecting links 86 comprises a pair of link sections 88 having adjacent ends overlapped and pivotally secured together by means of a pivot fastener 90 extending transversely of the link sections 88. In addition, the other pair of ends of the link sections include anchor portions 92 pivotally supported therefrom as at 94 for oscillation about axes generally paralleling the axis of relative angular displacement of the link sections 88. Each of the anchor portions 92 includes a partial cylindrical spring clamp 96 defining an entrance throat 98 of a width at least slightly less than the inside diameter of the spring clamps 96. The spring clamps 96 are constructed of stiff but somewhat resilient material whereby the free ends of the arms of the clamps may be slightly spread apart in order to allow the spring clamps 96 to be releasably clamped on the lower ends of the standards 34. The articulated connection between the link sections 88 of each connecting link 86 is such to allow the connecting links 86 to "break" upwardly at their mid-portions from the positons thereof illustrated in FIG. 1 of the drawings, but which will prevent the mid-portions of the connecting links 86 from breaking downwardly from the positions thereof illustrated in FIG. 1.

Inasmuch as each pair of standards 34 and 36 is rigidly interconnected by the corresponding upper and lower braces 38 and 40 considerable stability of the rack 16 is afforded. Also, when the connecting links 86 are in the extended positions thereof illustrated in FIG. 1 of the drawings, additional stability of the rack 16 is afforded.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A folding clothes rack comprising at least two pairs of upright standards spaced along a horizontal zig-zag path, upper and lower generally horizontal brace members extending between and rigidly secured to the upper and lower ends of each pair of standards, a pair of upper and lower elongated and generally horizontal spacing and support members extending between upper and lower end portions of the adjacent standards, along said path, of said pairs of standards with the opposite ends of said spacing and support members anchored to said adjacent standards for relative displacement about the center longitudinal axes of said adjacent standards, and elongated articulated link means connected between adjacent pairs of standards with the link means connected at one end to one standard of a first pair of standards and at the other end to another standard spaced two standards along said path from said one standard, said articulated link means comprising a pair of link sections having one pair of ends pivotally secured together for relative angular displacement about a horizontal axis extending transversely of said link sections, the other pair of ends of said link sections including anchor portions pivotally secured thereto for oscillation about axes generally paralleling said horizontal axis and supported from said one standard and said second standard spaced therefrom at points adjacent but spaced above the lower ends thereof for angular displacement relative thereto about axes extending longitudinally therealong, said link sections being pivotally connected at said one pair of ends thereof for relative angular displacement of said link sections between first limit positions with said link sections generally paralleling each other in side-by-side upstanding relation with said other pair of ends thereof uppermost and second limit positions with said link sections disposed in generally end aligned relation, said anchor portions including partial cylindrical spring clamp members snap fittingly and rotatably engaged with said one standard and said second standard spaced therefrom.

* * * * *